US012304675B1

(12) United States Patent
Liu

(10) Patent No.: US 12,304,675 B1
(45) Date of Patent: May 20, 2025

(54) MATERIAL ENCAPSULATION DEVICE

(71) Applicant: Shenzhen Aowei Technology Co., LTD, Guangdong (CN)

(72) Inventor: Yuhao Liu, Guangdong (CN)

(73) Assignee: Shenzhen Aowei Technology Co., LTD, Shenzhen (CN)

( * ) Notice: Subject to any disclaimer, the term of this patent is extended or adjusted under 35 U.S.C. 154(b) by 0 days.

(21) Appl. No.: 19/023,355

(22) Filed: Jan. 16, 2025

(51) Int. Cl.

| | |
|---|---|
| ***B65B 29/02*** | (2006.01) |
| ***B65B 1/02*** | (2006.01) |
| ***B65B 1/04*** | (2006.01) |
| ***B65B 1/24*** | (2006.01) |

(52) U.S. Cl.
CPC ..... *B65B 29/022* (2017.08); *B65B 1/02* (2013.01); *B65B 1/04* (2013.01); *B65B 1/24* (2013.01)

(58) Field of Classification Search
CPC B65B 29/022; B65B 1/02; B65B 1/04; B65B 1/24; B65B 7/2821; B65D 85/8052
USPC ..... 53/436
See application file for complete search history.

(56) References Cited

U.S. PATENT DOCUMENTS 2,046,367 A * 7/1936 Collins ..... B65B 1/24 426/414
2,181,945 A * 12/1939 Komarik ..... B65B 1/24 141/390
2,524,243 A * 10/1950 Wicklund ..... B65B 67/02 141/342
2,626,738 A * 1/1953 Nordquist ..... B65B 1/24 222/386
2,693,752 A * 11/1954 Garapolo ..... B30B 15/16 100/269.12
3,748,819 A * 7/1973 Christensson ..... B65B 43/50 53/527
4,147,014 A * 4/1979 Tashiro ..... B29C 51/32 53/563
4,338,765 A * 7/1982 Ohmori ..... B65D 3/06 53/471
4,596,110 A * 6/1986 Weiler ..... B29C 66/5344 53/410
4,957,753 A * 9/1990 Bardsley ..... B65B 1/24 220/624
5,168,794 A * 12/1992 Glucksman ..... A47J 31/465 99/305
5,445,562 A * 8/1995 Brunell ..... A22C 7/0046 100/283

(Continued)

*Primary Examiner* — Dariush Seif
(74) *Attorney, Agent, or Firm* — Ying-Ting Chen

(57) ABSTRACT

The utility model relates to a material encapsulation device, including a base and an upper cover. The base is provided with a placing cavity for placing a container shell, and the upper cover is detachably and rotatably connected to the base. A top of the base is provided with a mounting part, and the upper cover is provided with a mounting groove that is matched with the mounting part. The mounting part is provided with a positioning stopper, and the positioning stopper extends along a circumferential direction of the base. When a user places a sealing film to encapsulate the container shell, an edge of the sealing film is abutted against a side wall of the positioning stopper, to facilitate positioning of the sealing film. In addition, when the upper cover rotates relative to the base, the positioning stopper plays a role of guiding, so that the upper cover rotates more smoothly.

10 Claims, 4 Drawing Sheets

(56) References Cited

U.S. PATENT DOCUMENTS 5,496,573 A * 3/1996 Tsuji ..... B01D 39/163 426/433
5,520,105 A * 5/1996 Healy ..... B30B 1/24 99/545
5,526,733 A * 6/1996 Klawuhn ..... A47J 31/3671 99/287
5,584,239 A * 12/1996 Yelczyn ..... B30B 9/321 100/902
5,618,570 A * 4/1997 Banks ..... A47J 31/20 99/287
5,637,335 A * 6/1997 Fond ..... B65D 85/8043 426/77
D386,503 S * 11/1997 Emerson ..... D15/123
5,722,313 A * 3/1998 Schmed ..... A47J 31/3614 99/289 R
5,809,867 A * 9/1998 Turner ..... A47J 31/20 99/287
5,897,899 A * 4/1999 Fond ..... A47J 31/3695 426/77
5,941,055 A * 8/1999 Coates ..... B65B 61/20 425/134
6,260,475 B1 * 7/2001 Tegel ..... B30B 1/04 99/287
6,481,338 B1 * 11/2002 Wai ..... A47J 31/0663 99/302 R
6,832,542 B2 * 12/2004 Hu ..... A47J 31/0673 99/302 R
6,854,378 B2 2/2005 Jarisch et al.
8,051,766 B1 * 11/2011 Yu ..... A47J 31/20 99/287
8,176,714 B2 5/2012 Abegglen et al.
8,202,560 B2 6/2012 Yoakim et al.
8,479,638 B2 * 7/2013 Leung ..... A47J 31/44 99/302 R
8,927,037 B2 * 1/2015 Kihnke ..... A47J 31/0673 426/77
9,232,872 B2 * 1/2016 Rivera ..... A47J 31/0689
9,586,709 B1 * 3/2017 Rivera ..... B65B 7/28
11,198,557 B2 12/2021 Kamerbeek et al.
11,369,226 B2 * 6/2022 Rivera ..... B65D 85/8043
2002/0078831 A1 * 6/2002 Cai ..... A47J 31/14 99/295
2003/0096038 A1 * 5/2003 Cai ..... A47J 31/14 426/77
2004/0206243 A1 * 10/2004 Foster ..... A47J 31/44 99/279
2005/0132890 A1 * 6/2005 Constantine ..... A47J 31/44 99/275
2007/0132164 A1 * 6/2007 Petiziol ..... A47J 31/44 267/133
2007/0144357 A1 * 6/2007 Rivera ..... A47J 31/08 99/295
2007/0196551 A1 * 8/2007 Campetella ..... A47J 31/3609 426/438
2008/0299262 A1 * 12/2008 Reati ..... B65B 61/20 83/84
2011/0162533 A1 * 7/2011 Fumagalli ..... A47J 31/3695 99/295
2013/0139699 A1 * 6/2013 Rivera ..... B65D 85/8061 99/295
2013/0167729 A1 * 7/2013 Hoare ..... A47J 31/4464 99/287
2013/0186046 A1 * 7/2013 Magniet ..... B65D 85/8052 81/3.48
2014/0290493 A1 * 10/2014 Rivera ..... A47J 31/407 99/295
2015/0056331 A1 * 2/2015 Rivera ..... B65D 85/8052 99/287
2016/0145038 A1 * 5/2016 Apone ..... A47J 42/46 53/445
2016/0157661 A1 * 6/2016 Torquemada ..... A47J 31/0657 99/323
2016/0257548 A1 * 9/2016 Rivera ..... B67C 11/02
2017/0360057 A1 * 12/2017 Rivera ..... A47J 43/281
2017/0360239 A1 * 12/2017 Rivera ..... A47J 31/0689
2017/0361961 A1 * 12/2017 Rivera ..... A47J 31/0689
2020/0189772 A1 * 6/2020 Rivera ..... B65B 29/022
2021/0253334 A1 * 8/2021 Rivera ..... A23F 5/262
2022/0009661 A1 * 1/2022 Rivera ..... B65B 1/24
2022/0053965 A1 * 2/2022 Caillenton ..... A47J 31/0663
2022/0354745 A1 * 11/2022 Dadachanji ..... B65D 51/002
2022/0355959 A1 * 11/2022 Liu ..... B30B 1/00

* cited by examiner

MATERIAL ENCAPSULATION DEVICE

TECHNICAL FIELD

The utility model relates to the technical field of material container encapsulation, and in particular to a material encapsulation device.

BACKGROUND

Coffee capsules are popular because the coffee capsules are not required to go through bean grinding and are easy to brew, and have the same taste and quality when brewed. However, as disposable products, the coffee capsules not only increase costs but also cause waste and environmental pollution to some extent. Therefore, a device has emerged on the market that can re-encapsulate the coffee capsules, which is configured to press sealing films in the coffee capsules onto a container shell of a material. For example, Chinese Patent CN113200165A discloses a quick self-made tool for coffee capsules, including a die base and a press die. An opening of the sealing film for sealing a container shell can be made into a coffee capsule through molding of the press die, so that the coffee capsule can be reused. However, the press die is not easily aligned with the die base, or an edge of the material container is not evenly sealed.

SUMMARY

The utility model provides a material encapsulation device, to resolve a problem that the alignment between a pressing die and a die base is easily inaccurate when a user rotates the pressing die, or an edge of a coffee capsule is unevenly sealed.

To solve the above technical problem, the following solutions are used in the utility model:

- a material encapsulation device, configured to make a material container and including:
- a base, provided with a placing cavity for placing a container shell; and
- an upper cover, detachably and rotatably connected to the base, where
- a top of the base is provided with a mounting part, the upper cover is provided with a mounting groove matched with the mounting part, the mounting part is provided with a positioning stopper, and the positioning stopper extends along a circumferential direction of the base.

In one embodiment, there is one or more positioning stoppers, and the plurality of positioning stoppers extend along a circumferential direction of the mounting part and are arranged at intervals.

In one embodiment, the mounting part is provided with one or more positioning protrusions, and the positioning protrusions are arranged at intervals with the positioning stoppers.

In one embodiment, the height of the positioning protrusion is less than the height of the positioning stopper.

In one embodiment, the mounting part is of a step structure, the step structure includes a first step surface and a second step surface, the first step surface communicates with the placing cavity, the height of the second step surface is less than the height of the first step surface, the mounting groove is a step groove, the step groove includes a first groove matched with the first step surface and a second groove matched with the second step surface, and the depth of the second groove is less than the depth of the first groove.

In one embodiment, the mounting groove further includes an accommodating groove extending along a circumferential direction of the upper cover, the accommodating groove is located between the first groove and the second groove, and the accommodating groove is configured to accommodate protrusion of an edge of the material container.

In one embodiment, the step structure further includes a third step surface, the height of the third step surface is less than the height of the second step surface, and the upper cover further includes a lower surface matched with the third step surface.

In one embodiment, the positioning stopper is disposed on the second step surface, the width of a bottom of the second groove is less than the width of the second step surface, a positioning stopper groove is disposed between the lower surface and the bottom of the second groove, and a side wall of the positioning stopper groove is provided with one or more guide blocks.

In one embodiment, the upper cover is provided with a powder guide channel, the powder guide channel has a large end and a small end that are relative to each other, the large end communicates with the outside, the small end communicates with the placing cavity, and a central axis of the powder guide channel is collinear with a central axis of the base.

In one embodiment, the material encapsulation device further includes a spoon, the spoon includes a spoon head and a material pressing part that are connected, the scoop head is capable of scooping a material into the material container, and the material pressing part is capable of flattening and compacting the material.

It can be learned from the above technical solutions that the embodiments of the utility model have at least the following advantages and positive effects.

The material encapsulation device of the utility model includes the base and the upper cover. The top of the base is provided with the mounting part, and the upper cover is provided with the mounting groove matched with the mounting part. The mounting part is provided with the positioning stopper, and the positioning stopper extends along the circumferential direction of the base. When a user places the sealing film, an edge of the sealing film is abutted against a side wall of the positioning stopper, to facilitate positioning of the sealing film. In addition, when the upper cover rotates relative to the base, the positioning stopper plays a role of guiding, so that the upper cover rotates more smoothly.

BRIEF DESCRIPTION OF DRAWINGS

To describe technical solutions in embodiments of the utility model or in the prior art more clearly, the following briefly describes accompanying drawings required for describing the embodiments or the prior art. Apparently, the accompanying drawings in the following description show merely some embodiments of the utility model, and a person of ordinary skill in the art may derive other drawings from these accompanying drawings without creative efforts.

Figure 1:
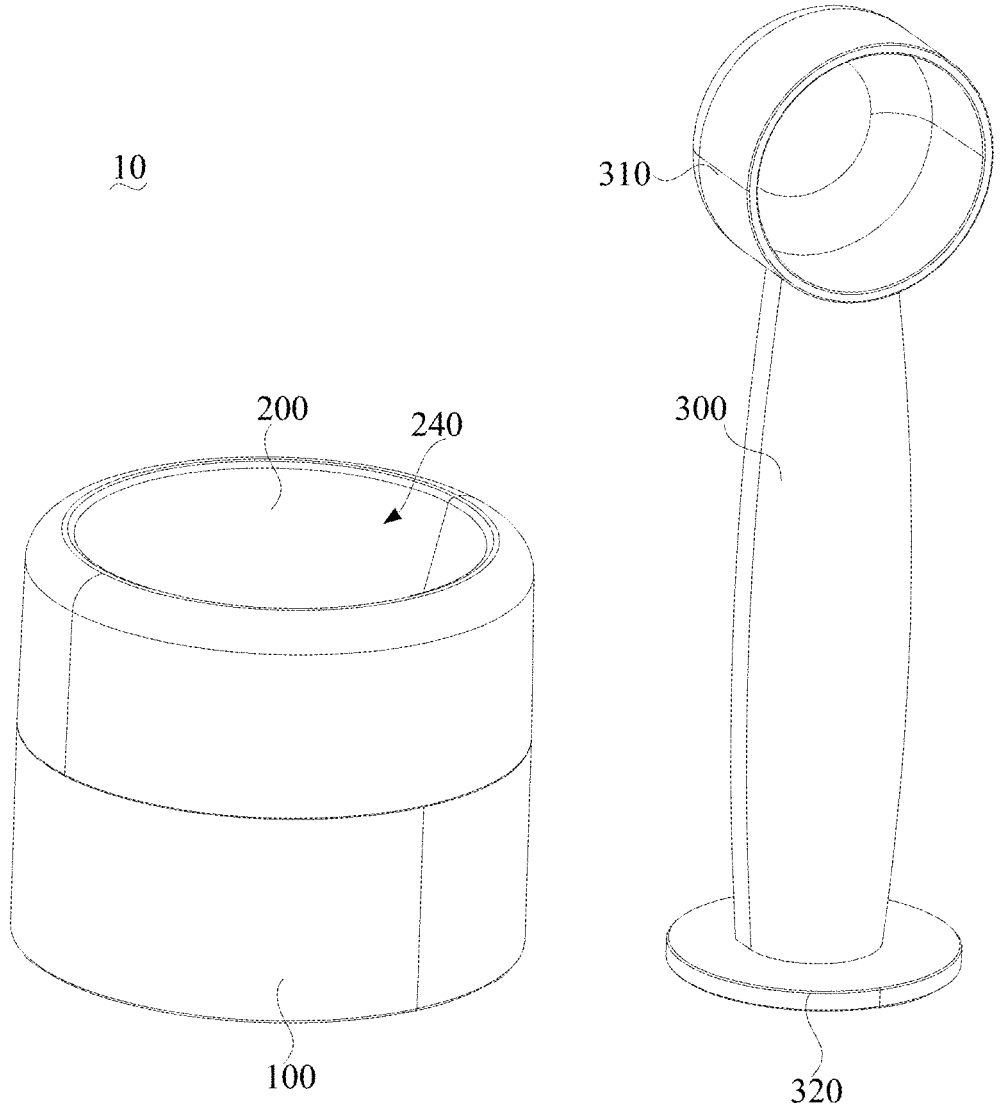
FIG. 1 is a schematic overall structural diagram of a material encapsulation device according to an embodiment of the utility model.

Reference numerals are described as follows:

10. material encapsulation device; 100. base; 110. placing cavity; 120. mounting part; 121. positioning stopper; 122. positioning protrusion; 123. step structure; 124. first step surface; 125. second step surface; 126. third step surface; 200. upper cover; 210. mounting groove; 211. step groove; 212. first groove; 213. second groove; 214. accommodating groove; 220. lower surface; 230. positioning stopper groove; 231. guide block; 240. powder guide channel; 241. large end; 242. small end; 300. spoon; 310. spoon head; 320. material pressing part.

DESCRIPTION OF EMBODIMENTS

Typical embodiments embodying features and advantages of the utility model are described in detail in the following description. It should be understood that the utility model can have different variations in different embodiments within the scope of the utility model, and the descriptions and illustrations are in essence intended for illustrative purposes and not to limit the utility model.

In addition, the terms "first" and "second" are only used for descriptive purposes, and cannot be understood as indicating or implying relative importance or implicitly indicating a quantity of indicated technical features. Therefore, a feature limited by "first" or "second" may explicitly or implicitly include one or more features. In the description of this application, "a plurality of" means two or more than two, unless otherwise specifically for limitation.

In the description of this application, it should be noted that, unless otherwise expressly stipulated and defined, terms "dispose", "link", "connect", should be understood in a broad sense. For example, "connection" may be a firm connection, a detachable connection, or an integral connection; may be a mechanical connection, or an electrical connection; or may be a direct connection, an indirect connection through an intermediate medium, or a connection between two elements. A person of ordinary skill in the art can understand specific meanings of the terms in this application based on specific situations.

First, refer to FIG. 1. The utility model provides a material encapsulation device 10 configured to make a material container. The material encapsulation device 10 can repeatedly press a sealing film on a container shell filled with a material, so that the material is repeatedly loaded in the material container, and the material container can be used many times, thereby reducing costs, and reducing the pollution of the material container to the environment.

It should be noted that the material may be powder-shaped, granular, flake-shaped, or the like, and the material may be coffee powder, tea leaves, or the like. In an embodiment, the material is coffee powder, and the material encapsulation device 10 can encapsulate the coffee powder into coffee capsules.

It should be noted that the material container includes the container shell and a sealing film. The container shell is provided with an opening, an edge of the sealing film is provided with sealant, and the sealing film includes a film covering part and a film removal part. The film covering part is configured to cover the opening of the material container, so that the material is sealed in the material container. The film removal part is configured to be held by a user, and the film removal part can drive the film covering part to be separated from the container shell.

Figure 2:
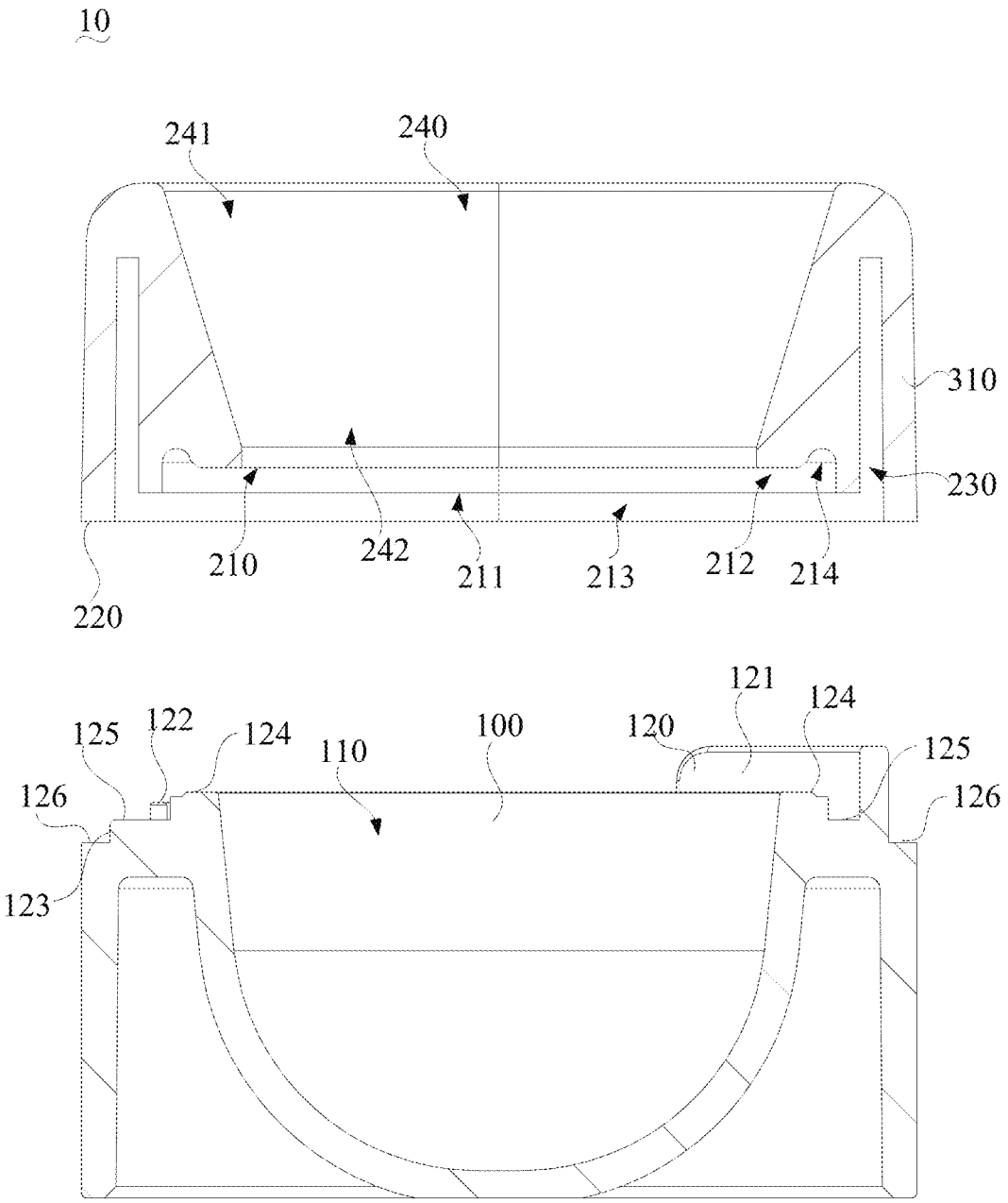
FIG. 2 is a schematic diagram of a sectional structure of the material encapsulation device shown in FIG. 1.

Refer to FIG. 1 and FIG. 2. The material encapsulation device 10 includes a base 100 and an upper cover 200. The base 100 is provided with a placing cavity 110 for placing the container shell, and the upper cover 200 is detachably and rotatably connected to the base 100. A top of the base 100 is provided with a mounting part 120, and the upper cover 200 is provided with a mounting groove 210 that is matched with the mounting part 120. The mounting part 120 is provided with a positioning stopper 121, and the positioning stopper 121 extends along a circumferential direction of the mounting part.

In this way, when the user places the sealing film, the edge of the sealing film is abutted against a side wall of the positioning stopper 121, to facilitate positioning of the sealing film. In addition, when the upper cover 200 rotates relative to the base 100, the positioning stopper 121 also plays a role of guiding, so that the upper cover 200 rotates more smoothly.

Figure 3:
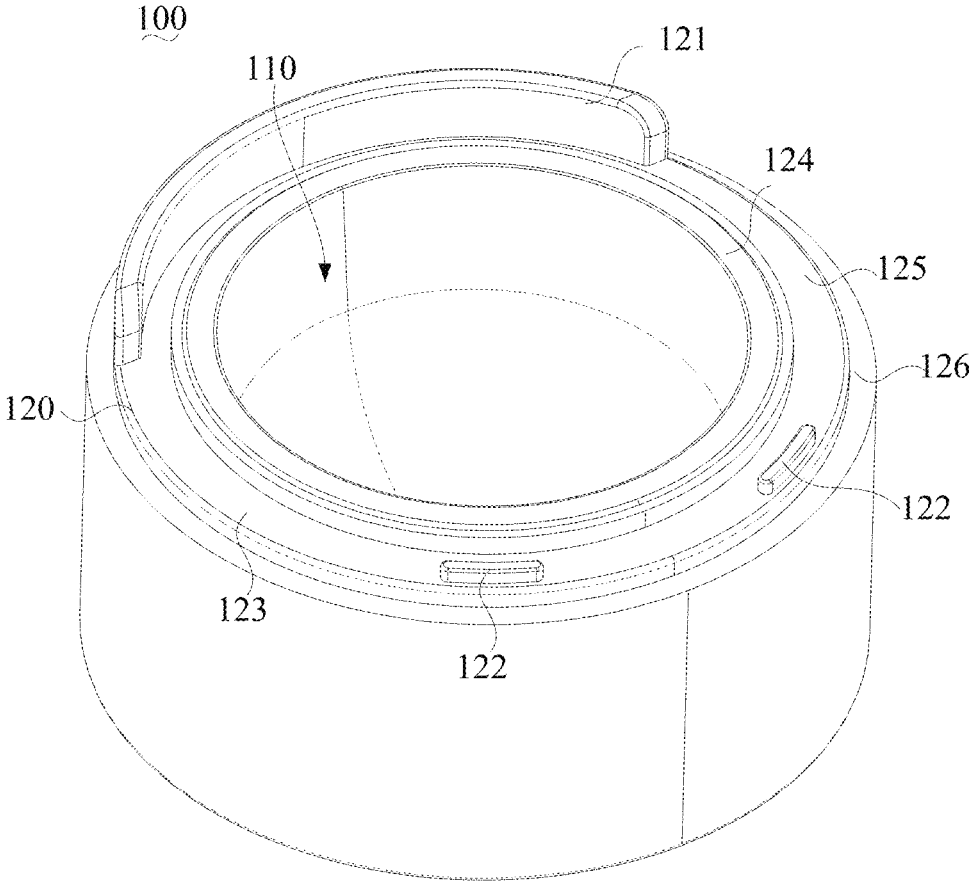
FIG. 3 is a schematic structural diagram of a base of the material encapsulation device shown in FIG. 1.

Refer to FIG. 3. In this embodiment, there is one positioning stopper 121. It should be noted that, in other embodiments, there is a plurality of positioning stoppers 121, and the plurality of positioning stoppers 121 extend along the circumferential direction of the mounting part 120 and are arranged at intervals. When the user places the sealing film, the user can place the film removal part of the sealing film between two adjacent positioning stoppers 121, and the adjacent two positioning stoppers 121 can restrict the rotation of the film removal part relative to the base 100, to limit the rotation of the sealing film relative to the base 100.

Refer to FIG. 3. It should be noted that, the mounting part 120 is provided with one or more positioning protrusions 122. For example, as shown in FIG. 3, the mounting part 120 is provided with two positioning protrusions 122, the positioning protrusions 122 are arranged at intervals with the positioning stoppers 121, and the height of the positioning protrusion 122 is less than the height of the positioning stopper 121. When the user mounts the sealing film, the user abuts an edge of the sealing film against a side wall of the positioning stopper 121, and pastes the sealing film to a top of the positioning protrusion 122, so that the sealing film is fastened to the base 100, which can effectively prevent the following problem: when the user rotatably mounts the upper cover 200 on the base 100, the upper cover 200 drives the sealing film to rotate relative to the base 100, causing the sealing film to be dislocated from the container shell. Therefore, the material can be sealed extremely well.

It can be understood that the height of the positioning protrusion 122 is less than the height of the positioning stopper 121. When placing the sealing film, the user can make the edge of the sealing film enter from one side of the positioning protrusion 122 to the top of the base 100 and approach a side wall of the positioning stopper 121. After the sealing film is placed, two sides of the sealing film are respectively limited by the positioning stopper 121 and the positioning protrusion 122, to prevent the dislocation of the sealing film.

It should be noted that, in other embodiments, positions of the mounting part 120 and the mounting groove 210 can be reversed with each other. In this case, the mounting part 120 is disposed on the upper cover 200, and the mounting groove 210 is provided on the top of the base 100.

Figure 4:
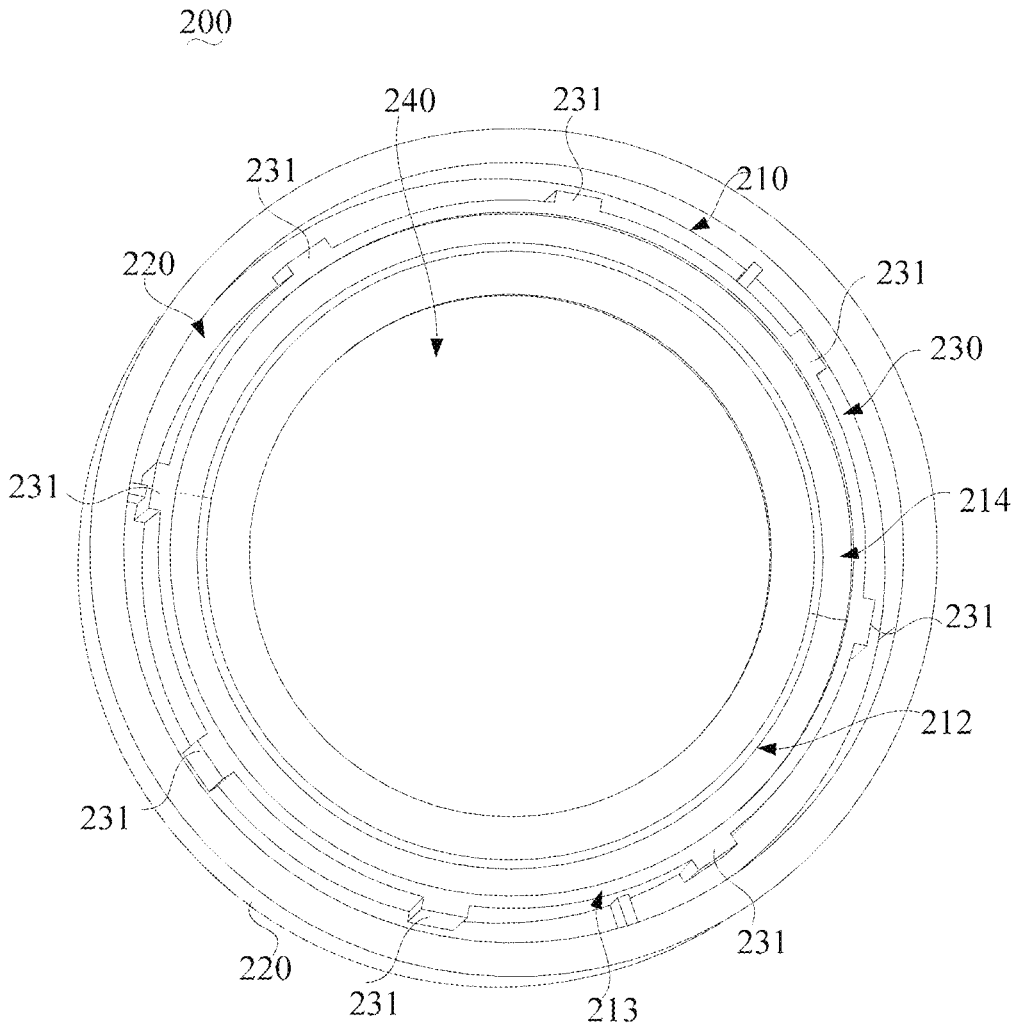
FIG. 4 is a schematic structural diagram of an upper cover of the material encapsulation device shown in FIG. 1.

Refer to FIG. 2. The mounting part 120 is of a step structure 123. FIG. 3 illustrates that the step structure 123 includes a first step surface 124 and a second step surface 125. The first step surface 124 communicates with the placing cavity 110, and the height of the second step surface 125 is less than the height of the first step surface 124. FIG. 4 illustrates that the mounting groove 210 is specifically a step groove and the step groove includes a first groove 212 and a second groove 213. A bottom of the first groove 212 is matched with the first step surface 124, a bottom of the second groove 213 is matched with the second step surface 125, and the depth of the second groove 213 is less than the depth of the first groove 212. When the upper cover 200 is mounted on the base 100, the bottom of the first groove 212 is abutted against the first step surface 124, and the bottom of the first groove 212 has a specific width, so that the sealing film is pressed, to restrict the movement of the sealing film relative to the base 100. In addition, the bottom of the second groove 213 pushes the edge of the sealing film to fit an edge of the container shell, thereby achieving the sealing effect. In addition, the edge of the sealing film is limited by a side wall of the first groove 212, so that the sealing film does not slide or slides slightly on the first step surface 124, and the sealing film is accurately aligned with the container shell. It can be understood that, in other embodiments, when the sealing effect of the material container is not considered, the first step surface 124, the second step surface 125, the first groove 212, and the second groove 213 may not be disposed. A solution in which the movement of the sealing film relative to the base 100 can be restricted should be protected.

Refer to FIG. 3. It should be noted that the positioning stopper 121 is disposed on the second step surface 125.

Refer to FIG. 2 and FIG. 4. It should be noted that, in this embodiment, the mounting groove 210 further includes an accommodating groove 214 extending along a circumferential direction of the upper cover 200. The accommodating groove 214 is located between the first groove 212 and the second groove 213. The accommodating groove 214 is configured to accommodate protrusion of an edge of the material container, and a groove wall of the accommodating groove 214 can limit sliding of the material container in a horizontal plane. It can be understood that, without regard to the protrusion of the edge of the material container and the limitation of sliding of the material container in the horizontal plane, the accommodating groove 214 may not be disposed. A solution in which the upper cover 200 can rotate relative to the base 100 and be mounted on the base 100 should be protected.

Refer to FIG. 2 and FIG. 3. The step structure 123 further includes a third step surface 126. The height of the third step surface 126 is less than the height of the second step surface 125, and the third step surface 126 is farthest away from the placing cavity 110 relative to the first step surface 124 and the second step surface 125. The upper cover 200 further includes a lower surface 220 matched with the third step surface 126. When the upper cover 200 covers the base 100, the lower surface 220 is abutted against the third step surface 126, enhancing air tightness between the upper cover 200 and the base 100. It can be understood that the lower surface 220 and the third step surface 126 may not be disposed. A solution in which the upper cover 200 can rotate relative to the base 100, and the upper cover 200 can be mounted on the base 100 should be protected.

Refer to FIG. 2 and FIG. 4. The width of the bottom of the second groove 213 is less than the width of the second step surface 125, so that a positioning stopper groove 230 can be disposed between the lower surface 220 and the bottom of the second groove 213, and one or more guide blocks 231 are disposed on a side wall of the positioning stopper groove 230. For example, as shown in FIG. 4, in this embodiment, the side wall of the positioning stopper groove 230 is provided with eight guide blocks 231. When the user covers the upper cover 200 on the base 100, the positioning stopper 121 is embedded in the positioning stopper groove 230 and rotates along the positioning stopper groove 230. In this case, two opposite side walls of the positioning stopper 121 are respectively abutted against a side wall of the guide block 231 and a side wall of the positioning stopper groove 230, and the positioning stopper 121 plays a guiding role.

Refer to FIG. 2 and FIG. 4. The upper cover 200 is provided with a powder guide channel 240. The powder guide channel 240 has a large end 241 and a small end 242 that are opposite to each other along a height direction of the material encapsulation device 10, the large end 241 communicates with the outside, and the small end 242 communicates with the placing cavity 110. A central axis of the powder guide channel 240 is collinear with a central axis of the base 100, and a material can slide, along the powder guide channel 240, into the material container placed in the placing cavity 110, so that a material can be prevented from sprinkling on a top surface of the base 100 when the user is loading the material, thereby facilitating operation. It can be understood that the powder guide channel 240 may not be disposed. A solution in which the material can be loaded into the material container should be protected.

Refer to FIG. 1. The material encapsulation device 10 further includes a spoon 300. The spoon 300 includes a spoon head 310 and a material pressing part 320 that are connected. The spoon head 310 can scoop the material into the material container, and the material pressing part 320 can flatten and compact the material that is packed in the material container, to facilitate user operation. It can be understood that, the spoon 300 may not be disposed without regard to facilitating user operation. A solution in which the material encapsulation device 10 includes the upper cover 200 and the base 100 should be protected.

In this embodiment, a process of using the material encapsulation device 10 by the user is as follows: unscrewing the upper cover 200, opening the upper cover 200, putting the container shell packing the material into the placing cavity 110, covering the upper cover 200, and scooping a specific amount of material into the powder guide channel 240 with the spoon head 310 of the spoon 300; opening the upper cover 200, and flattening and compacting the material with the material pressing part 320 of the spoon 300; taking a sealing film, abutting an edge of the sealing film against a side wall of the positioning stopper 121, and clamping the sealing film on the positioning protrusion 122; and finally mounting the upper cover 200 on the base 100, and rotating the positioning stopper 121 to a proper angle. In this case, a new material container has been made.

It should be noted that the specific amount of material depends on a capacity of the container shell.

Although the utility model has been described with reference to several typical implementations, it should be understood that the terms used are used for description and illustration, and not used for limitation. Because the utility model can be specifically implemented in a variety of forms without departing from the spirit or substance of the utility model, it should be understood that the above implementations are not limited to any of the above details, but should be interpreted broadly in the spirit and scope limited by the accompanying claims, so that all variations and modifications falling within the scope of the claims or equivalent variations shall be covered by the accompanying claims.

What is claimed is:

1. A material encapsulation device, configured to make a material container and comprising:

a base, provided with a placing cavity for placing a container shell; and an upper cover, detachably and rotatably connected to the base, wherein a top of the base is provided with a mounting part, the upper cover is provided with a mounting groove matched with the mounting part, the mounting part is provided with a positioning stopper, and the positioning stopper extends along a circumferential direction of the base.

2. The material encapsulation device according to claim 1, wherein there is one or more positioning stoppers, and the plurality of positioning stoppers extend along a circumferential direction of the mounting part and are arranged at intervals.

3. The material encapsulation device according to claim 1, wherein the mounting part is provided with one or more positioning protrusions, and the positioning protrusions are arranged at intervals with the positioning stoppers.

4. The material encapsulation device according to claim 3, wherein the height of the positioning protrusion is less than the height of the positioning stopper.

5. The material encapsulation device according to claim 1, wherein the mounting part is of a step structure, the step structure comprises a first step surface and a second step surface, the first step surface communicates with the placing cavity, the height of the second step surface is less than the height of the first step surface, the mounting groove is a step groove, the step groove comprises a first groove matched with the first step surface and a second groove matched with the second step surface, and the depth of the second groove is less than the depth of the first groove.

6. The material encapsulation device according to claim 5, wherein the mounting groove further comprises an accommodating groove extending along a circumferential direction of the upper cover, the accommodating groove is located between the first groove and the second groove, and the accommodating groove is configured to accommodate protrusion of an edge of the material container.

7. The material encapsulation device according to claim 5, wherein the step structure further comprises a third step surface, the height of the third step surface is less than the height of the second step surface, and the upper cover further comprises a lower surface matched with the third step surface.

8. The material encapsulation device according to claim 7, wherein the positioning stopper is disposed on the second step surface, the width of a bottom of the second groove is less than the width of the second step surface, and a positioning stopper groove is disposed between the lower surface and the bottom of the second groove; and when the upper cover is mounted on the base, the positioning stopper is embedded in the positioning stopper groove.

9. The material encapsulation device according to claim 1, wherein the upper cover is provided with a powder guide channel, the powder guide channel has a large end and a small end that are relative to each other, the large end communicates with the outside, the small end communicates with the placing cavity, and a central axis of the powder guide channel is collinear with a central axis of the base.

10. The material encapsulation device according to claim 1, wherein the material encapsulation device further comprises a spoon, the spoon comprises a spoon head and a material pressing part that are connected, the scoop head is capable of scooping a material into the material container, and the material pressing part is capable of flattening and compacting the material.

* * * * *